US005676122A

United States Patent [19]

Wiseby et al.

[11] Patent Number: 5,676,122

[45] Date of Patent: Oct. 14, 1997

[54] ARRANGEMENT FOR A BOW SIGHT

[76] Inventors: Tony Wiseby, Ljungaskogatan 4, S-512 93 Svenljunga; Dennis Wiseby, Box 30, S-512 21 Svenljunga, both of Sweden

[21] Appl. No.: 613,053

[22] Filed: Mar. 8, 1996

[30] Foreign Application Priority Data

Mar. 10, 1995 [SE] Sweden ..... 9500872

[51] Int. Cl.[6] ..... F41G 1/467

[52] U.S. Cl. ..... 124/87; 33/265

[58] Field of Search ..... 124/87; 33/265

[56] References Cited

U.S. PATENT DOCUMENTS

| | | | |
|---|---|---|---|
| 3,766,656 | 10/1973 | Westphal | 33/265 |
| 3,822,479 | 7/1974 | Kowalski | 33/265 |
| 4,481,717 | 11/1984 | Kowalski | 33/265 |
| 4,715,126 | 12/1987 | Holt | 33/265 |
| 4,910,874 | 3/1990 | Busch | 33/265 |
| 5,228,204 | 7/1993 | Khoshnood | 33/265 |
| 5,384,966 | 1/1995 | Gibbs | 33/265 |
| 5,507,272 | 4/1996 | Scantlen | 124/87 |
| 5,509,402 | 4/1996 | Sappington | 124/87 |
| 5,524,601 | 6/1996 | Slates et al. | 124/87 |

*Primary Examiner*—John A. Ricci
*Attorney, Agent, or Firm*—Dvorak & Orum

[57] ABSTRACT

An arrangement for a sight for a bow having at least two independently adjustable sighting members which are capable of being displaced and guided in the desired adjustment direction, and are supported by a guide intended for that purpose. At least one of the sighting members is capable of removable connection to a common drive member extending along the guides for the purpose of adjusting the sighting members independently of one another.

8 Claims, 6 Drawing Sheets

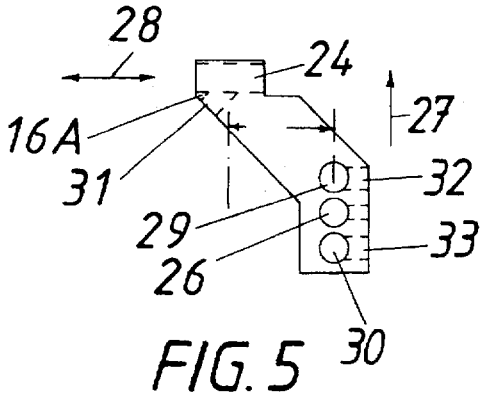
FIG. 5
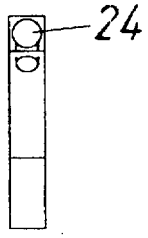
FIG. 5A
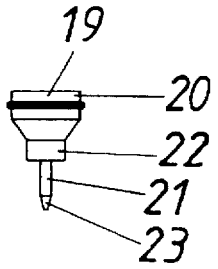
FIG. 6
FIG. 8
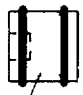
34,35
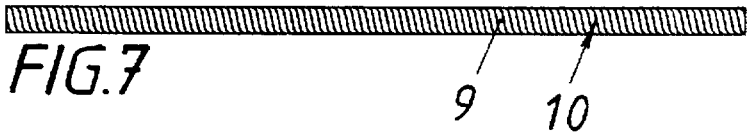
FIG. 7
FIG. 9
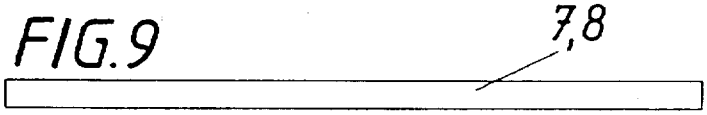
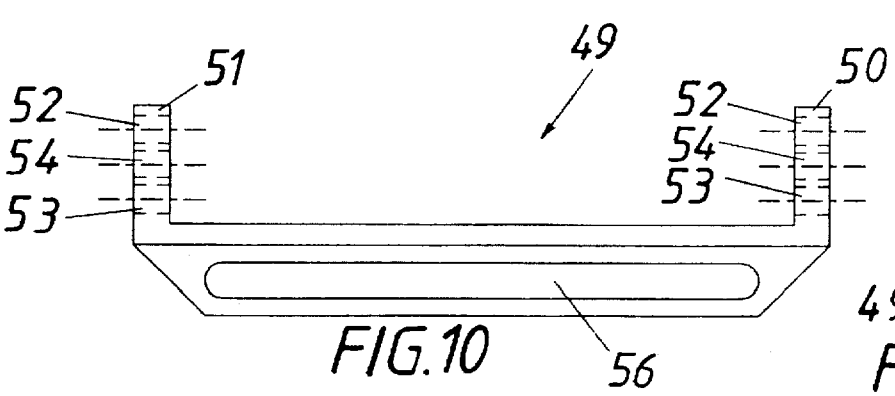
FIG. 10
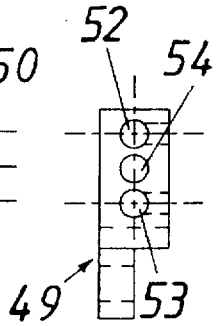
FIG. 10A
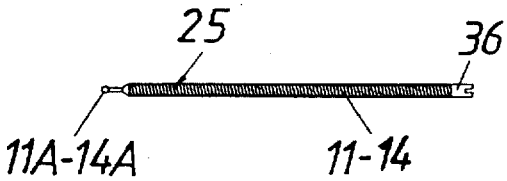
FIG. 11

ARRANGEMENT FOR A BOW SIGHT

The present invention relates to an arrangement for a sight for a bow comprising at least two independently adjustable sighting means, preferably in the form of sight pins supported by separate attachment holders, which are capable of being displaced and guided in the appropriate adjustment directions with the sighting means movably supported by a guide intended for that purpose, with at least one of the aforementioned sighting means being capable of detachable attachment to an adjustment shaft extending along said guide, which shaft is provided with an inclined track in the form of at least one thread.

The need exists to be able accurately to adjust intended sighting means, such as sight pins in sights intended to be used on bows intended for competition and hunting purposes, i.e. so-called 3-D sights.

Previously disclosed sights contain a number of sight pins adjustable to each of the intended shooting distances. Said sight pins are accommodated in the case of a previously disclosed sight in tracks with a sight pin in a threaded path along one edge surface of the track, along which rotatable adjustment controls for the respective sight pin are capable of interacting so as to be locked in the desired set position. Shooting is associated with the risk of these sight pins dropping down along the track openings when the bow is subjected to impacts and/or vibrates. This is a major disadvantage.

Another previously disclosed sight incorporates a number of attachments for sight pins supported by pairs of common guide tracks. Setting of the sight pins, i.e. their attachments, is performed manually, i.e. after having released a locking screw to release the attachment of the desired sight pin from the guide track, when the guide pin is displaced by hand and then locked in the set position. This is a very complicated setting procedure, since great accuracy must be observed both when moving the guide pin and its associated attachment and when locking it.

U.S. Pat. No. 5,228,204 relates to a bow sight, comprising:

a plurality of elongated sight pins;

a guiding means for defining at least one path;

at least one rotatable shaft;

an engagement means engaged to said rotatable shaft for longitudinally moving said pins along the path by rotating said shaft; and a locking means for preventing movements of a selected one of said plurality of sight pins along said path even when said shaft is rotated, and a sight block, comprising:

a plurality of elongated sight pins;

a plurality of carriers for carrying said elongated sight pins;

a base plate for mounting said sight pin carriers having a rotatable threaded shaft defining a movement path for only selected ones of the sight pin carriers as the threaded shaft is rotated, whereby each sight pin carrier comprises a user-activatable locking means for selectively preventing movement of the sight pin carrier in the longitudinal direction as the threaded shaft is rotated; and a means for mounting the sight block on the bow, and a sight block, comprising:

a plurality of elongated sight pins;

a plurality of carriers for carrying the elongated sight pins;

a base plate for mounting said sight pin carriers, which base plate exhibits a track defining a movement path;

a movement means comprising a knob for moving only selected ones of the sight pin carriers selected from amongst said plurality of sight pin carriers along said movement path as the knob is rotated, whereby each of said plurality of sight pin carriers comprises a user activatable locking means for preventing movement of the sight pin carrier even when the knob is rotated; and means for mounting the sight block on the bow.

Said previously disclosed sight is formed from a number of components, many of which are constantly in engagement with one another and can thus be affected by vibrations, as well as by the weather and wind, so that their setting is not so accurate, especially after a period when constituent parts which are constantly subjected to compressive forces are to be caused to move to new positions with new functions. See in particular the gear wheel (144), which acts between the male track of the threaded shaft (131) and not with the female track of the threaded shaft. Also provided is a locking means which acts by securely clamping the sight pin carrier (136) on a guide track, a function which is likely to be impaired after a certain period of use and locking with a high tensioning force.

The sight arrangement in accordance with U.S. Pat. No. 3,822,479 is extremely complicated with regard to both its construction and its use. This arrangement also comprises a plurality of loose elements and threads intended to interact with one another, which can lead to free play and incorrect adjustment of the sight.

Finally, a sight exists on which adjustment can be performed separately for each desired sight pin with the help of a rotatable threaded shaft which engages in the threads of the attachment means for the respective intended pin. Accurate adjustment is thus possible, although the sight is exceptionally cumbersome and heavy. It is also difficult rapidly to adjust the intended sight pin and its associated attachments to the correct position, since it is necessary to activate each of the designated adjustment shafts for each of the sight pins that it is wished to adjust.

Other previously disclosed sights are so cumbersome and complicated that they are not worthy of mention in this application and they do not contribute anything of value in connection with the design of a sight which inter alia solves the aforementioned problems in a simple and reliable fashion.

The principal object of the present invention is thus to solve the problems indicated above by simple, yet effective means.

Said object is achieved by means of an arrangement in accordance with the present invention, which is characterized essentially in that the adjustment shaft extends parallel with a plurality of guide rods extending for the purpose of guiding said sighting means, in that the attachment holders exhibit an opening which extends from the outside of the same inwards as far as the adjustment shaft for activating the adjustment shaft by means of a manual adjustment means functioning as a tool and acting through the opening, which adjustment means preferably exhibits a connection enabling it to be supported by the bow, and which has an upright extending from a manually activated activating means, which upright is provided with an engagement means, for example a chisel-shaped tip or a hexagonal key, etc., which fits into the track in the adjustment shaft in order that it may be detachably attached to the adjustment track in question, and in that the shaft is activated manually causing it to rotate, whereby the intended attachment holder is displaced along said guide rods for as long as the shaft continues to be rotated and the engagement means is connected to the adjustment track in question.

The present invention is described below as a preferred illustrative embodiment with reference to the accompanying drawings, in which:

FIGS. 5–15 show detailed views of sight components, where

FIG. 5 shows an attachment holder viewed from the side;

FIG. 5A shows the attachment holder viewed from the front;

FIG. 6 shows an adjustment device viewed from the side

FIG. 7 shows the adjustment shaft from above;

FIG. 8 shows an installation means from the side;

FIG. 9 shows a top view of a guide rod;

FIG. 10 shows a top view of a sight frame;

FIG. 10A shows an end view of a sight frame;

FIG. 11 shows a top view of a sight pin;

FIG. 12 shows a top view of a sight holder arm;

FIG. 13 shows an arm attachment screw from the side;

FIG. 14 shows a front view of an arm attachment means;

Figure 1:
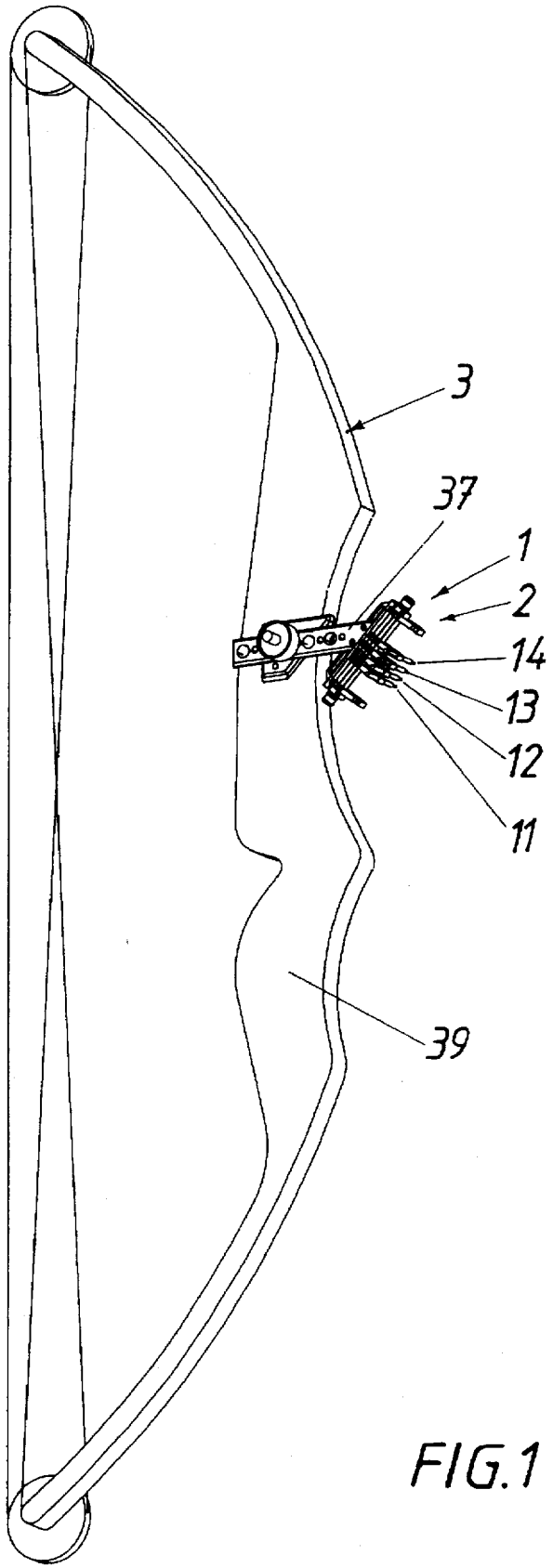
FIG. 1 shows a bow with a sight in accordance with the invention.
Figure 2:
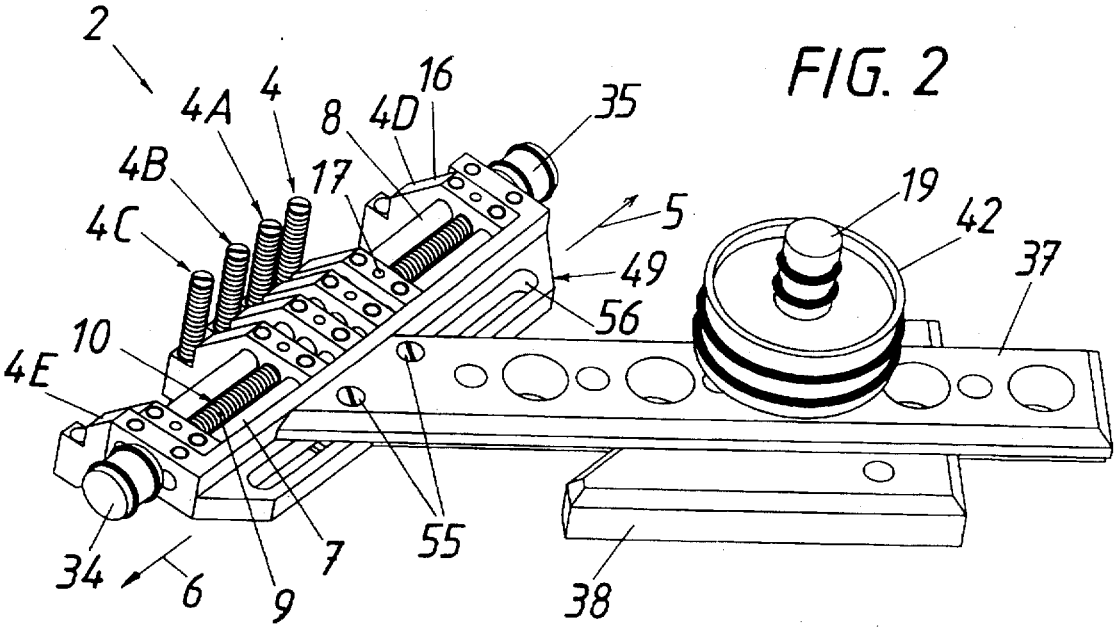
FIG. 2 shows the sight viewed in perspective from an angle above its installation plane.

An arrangement 1 in accordance with the present invention for a sight 2 intended for a bow 3, which comprises at least two separate and individually adjustable sighting means 4, 4A, 4B, 4C, 4D, 4E, which can be moved and guided in appropriate directions 5–6 of adjustment with the sighting means 4A–4E movably supported by a guide 7, 8 intended for the purpose, has at least one of said sighting means 4A–4E detachably attachable to a drive means 9 extending along said guide 7, 8.

A drive means for adjusting the sighting means is formed by a shaft 9 having an inclined track 10. Said inclined track 10 is formed by at least one thread which extends in a spiral manner as a screw thread with at least one lead-in.

Said adjustment shaft 9 extends essentially in parallel with a number of guide rods 7, 8 extending for guiding said sighting means, for which purpose preferably two guide rods 7, 8 are arranged extending in parallel with the adjustment shaft 9, with one guide rod 7 and 8 arranged respectively to either side of the adjustment shaft 9.

Sighting means preferably arranged in the form of sight pins 11, 12, 13, 14 of a previously disclosed kind, and possibly also a sight guard 15 and lighting, are supported by separate attachment holders 16. These attachment holders 16 exhibit an opening 17 which extends from the outside 18 of same and inwards to the adjustment shaft 9, in order in so doing to permit activation of the inclined track 10 by means of an adjustment device 19 acting through the opening 17.

Said adjustment device 19, which preferably exhibits a matching connection 22 enabling it to be supported by the bow 3 in question when the adjustment device 19 is not being used for adjustment and one is shooting with the bow, for example, after having completed adjustment of the sight, but that said adjustment device 19 is still close to hand for any further adjustment and fine adjustment of the sight 2, has an upright 21 projecting from an activating part 20. Said upright 21 is in turn provided with an engaging means 23, for example a chisel-shaped tip or a hexagonal key, etc., which fits into the track 10 in the adjustment shaft in order that it may be detachably attached to the adjustment track 10 in question.

As shown as a preferred illustrative embodiment of the attachment holder 16, a hole 24 exhibiting threads, which is arranged to accommodate a sight pin 11–14 of appropriate length with threads 25 screwed into it, extends across an accommodating hole 26, which is intended to be capable of being threaded on freely and to run along an intended rotatable adjustment shaft 9.

In an attachment holder of straight execution not shown in the drawings, said threaded hole 24 is situated directly outside an accommodating hole for an adjustment shaft. This means that the sight pins are long, and are accordingly sensitive to impacts and other external influences.

In order to avoid this, the holders 16 can be executed, for example, inclined with their outer end 16A and associated accommodating part laterally displaced for a certain distance A from the accommodating hole 26 for the adjustment shaft 9. Said threaded hole 24 is thus displaced both laterally and radially 27 from said accommodating hole 26, and also in the intended adjustment direction 28 for the connected sight pin 11–14, which exhibits an outer sight component 11A–14A, for example a ball.

Appropriate means are provided in order to permit locking of the various components in the set position, to the effect namely that a threaded hole 31, 32, 33, each of which accommodates its own stop screw which is so arranged as to be screwed in the bottom and to clamp said sight pins 11–14 securely, together with guide rods 7, 8, extends to the intended space, i.e. the hole 24 intended to accommodate sight pins 11–14 and parallel transcurrent holes 29, 30, each intended to accommodate its own guide bar 7, 8 in the holders 16, and in order, after screwing in place, to be capable once more of permitting movement of the intended adjustable components.

The invention thus makes it possible to produce a sight 2 which is compact and flexible, but above all simple to adjust. The sight pins 11–14 in question can be adjusted independently of one another with the help of the adjustment device 19 functioning as a tool, both vertically and laterally. The tool 19 is preferably also used to activate existing screws and sight pins 11–14 on the sight 2.

Figure 3:
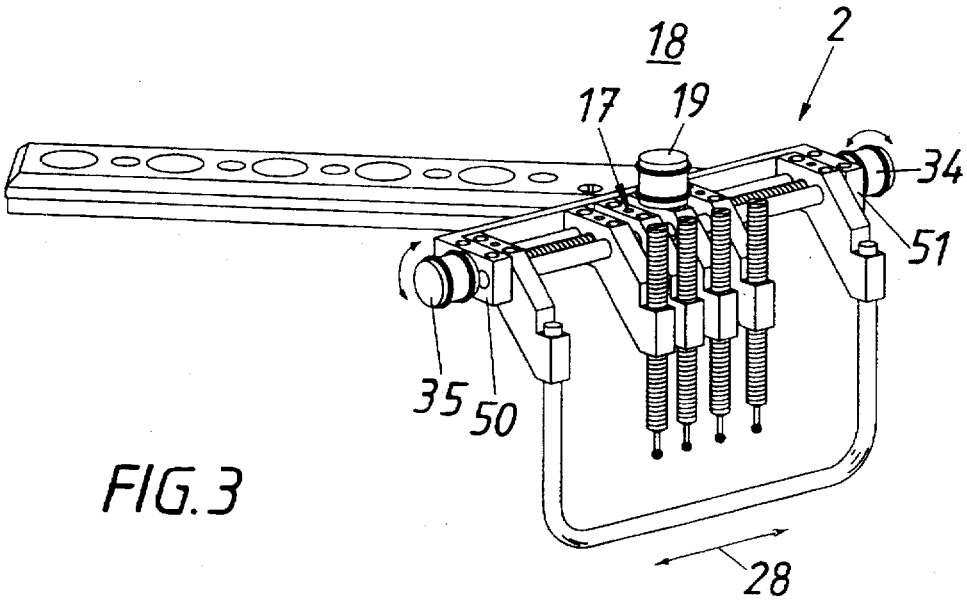
FIG. 3 shows the sight with parts of same removed and in an adjustment position.
Figure 3A:
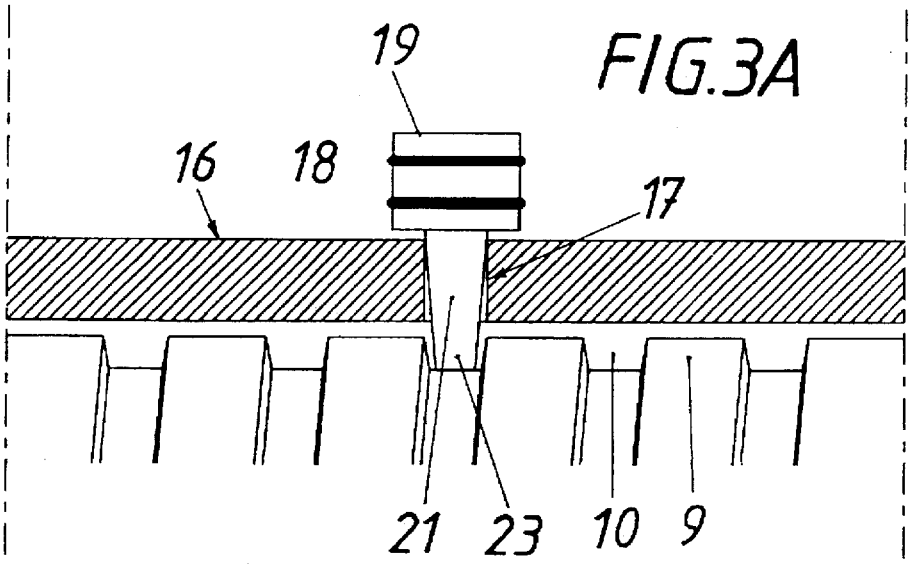
FIG. 3A shows a sectioned view of an attachment holder and a rotating part in the effective connecting position.
Figure 4:
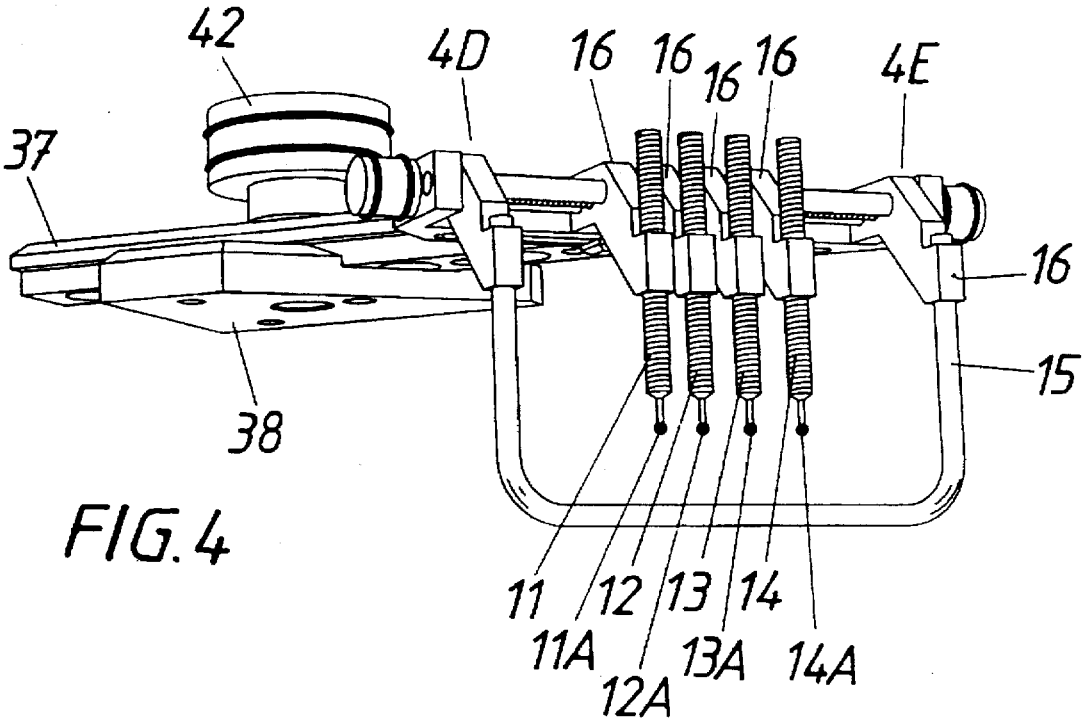
FIG. 4 shows the sight viewed at an angle from below one of its ends.
Figure 12:
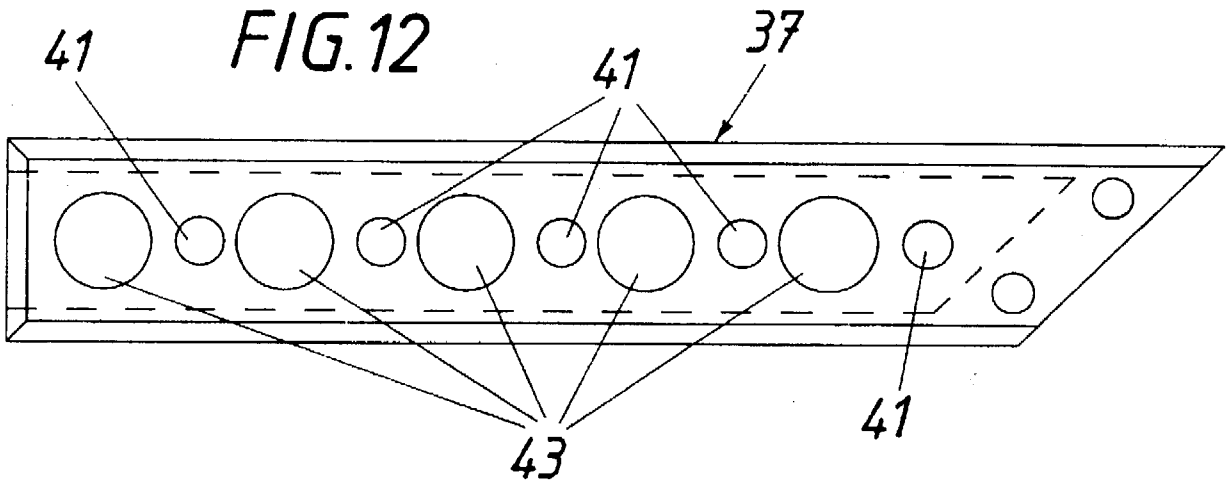
Figure 12A:
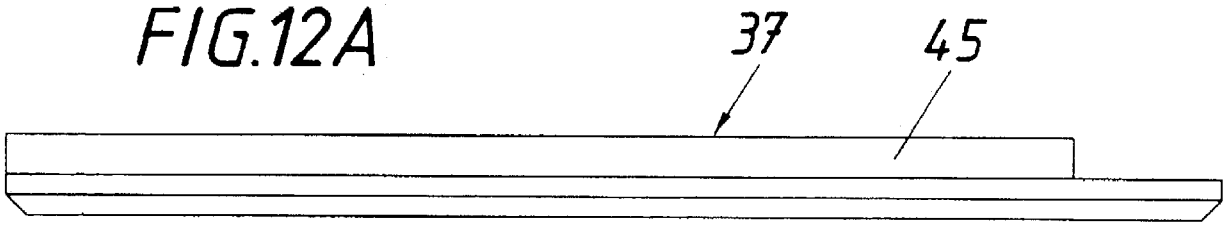
FIG. 12A shows a side view of the sight holder arm.
Figure 12B:
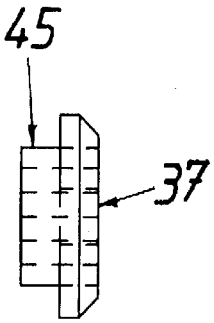
FIG. 12B shows an end view of the sight holder arm.
Figure 13:
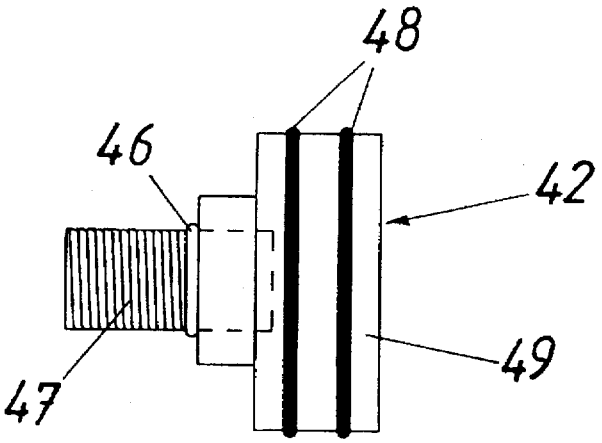
Figure 14:
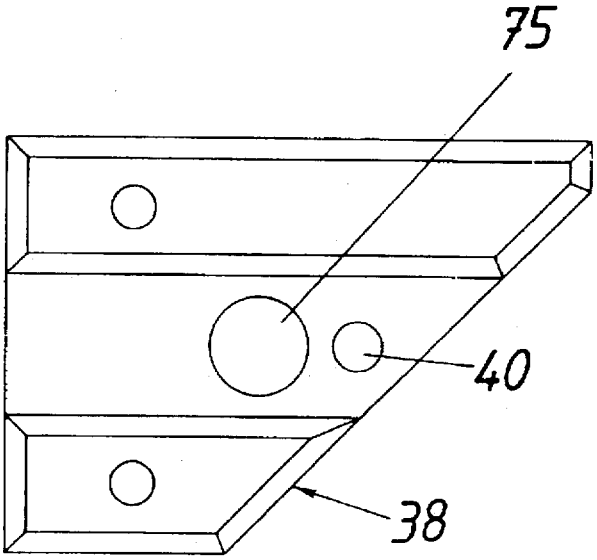
Figure 14A:
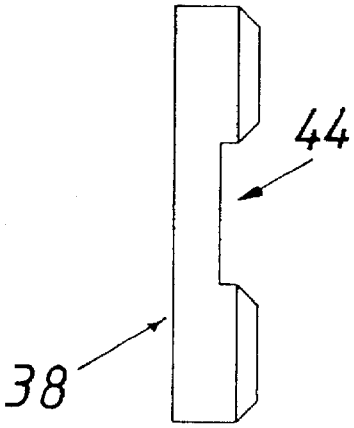
FIG. 14A shows an end view of said arm attachment means.

The sight adjustment function will doubtless have been appreciated from the foregoing and with the help of the drawings. It must be stated, briefly, that the adjustment device 19 is released from the sight 2 and the existing stop screws are released before inserting the upright 21 into the intended hole 17 in the intended holder 16 that it is wished to adjust along the drive means 9 for the purpose, as shown in FIG. 3A, of engaging with its activating means 23 in the track 10 in the drive means 9. When the activating knobs 34, 35 that are attached to said rod 9 provided with a track are now manually activated in such a way as to rotate, at the same time as the activating means 23 of the adjustment device 19 is caused to engage in the track 10, the intended attachment holder 16 will be displaced along the guide rods 7, 8 for as long as the rod 9 is rotated. The holder 16 is locked securely to the guide rods 7, 8 by means of the stop screws in the desired adjusted vertical position. Horizontal adjustment of the sight pins 11–14 can take place by screwing the pins 11–14 out or in by means of said adjustment device 19 by activating its screw component 36 at the rear.

It is thus possible to adjust any of said holders 16 by having to use only a single rod 9 provided with a track, although the holders 16 are unable to move past one another.

The sight 2 is executed in two illustrative embodiments, namely a straight form and a form inclined at 45°. This means that all archers can use the sight 2 irrespective of whether a fast or a slow bow 3 is being used.

The distance between the sight pins 11–14 in the vertical sense can be varied between 53 and 15 mm.

A protective rail 15, which is placed outside the sight pins 11–14 on certain occasions to protect them against activation, can be removed and turned, for example to face in the opposite direction, when the rail 15 is not required. The position of attachment holders 4D, 4E for the bow 15 can also be adjusted as described above. Lighting (not shown here) for use when shooting in half-light, for example, can be attached to the holders 4D, 4E. A spirit level can also be supported by the lower holder to facilitate holding the bow in the correct position.

The adjustability of the attachment holders 4D, 4E in the vertical sense means that it is now possible to bring the lighting and the spirit level closer to the sight pins 11–14, so that they all come within the archer's direct field of vision, thus relieving him of the need to move his gaze when shooting.

The design of the sight pin holders means that the sight pins 11–14 need not be as long as in previous sights 2, which reduces the risk of unintentional contact and resulting damage.

The attachment of the sight to a bow 3 is effected by means of a sight arm 37 of a special design capable of being fixed to a holder 38 on the stock 39 of the bow. A guide pin 40, for example on the holder 38, is so adapted as to be capable of being accommodated in an optional opening 41 in the sight arm 37 before screwing a knob-shaped fixing screw 42 into the intended hole 43, depending on the position in which the arm 37 is inserted into the holder 38. A track 44 in the holder 38 is intended to accommodate a matching part 45 of the sight arm 37 as a press-fit. This press-fit means that no free play occurs in the sight arm 37. The fixing screw 42 is locked in the threaded hole 75 of the holder.

The sight arm fixing screw 42 is preferably provided with an 'o'-ring 46 at the threaded part 47 and with a number of 'o'-rings 48 around the activating part 49 of the screw, whereby one of the 'o'-rings 46 functions as a screw locking device to prevent loosening and the other 'o'-ring 48 functions as a gripping means. This arrangement of 'o'-rings can be used for all screws that are positively activated in conjunction with adjusting the sight, in order both to reduce the risk of loosening due to vibrations and to provide a secure grip.

A sight holder frame 49, for example of U-shaped cross-section, is so arranged as to accommodate guide bars 7, 8 and a drive means 9 between its pairs of legs 50, 51 in appropriate holes 52, 53, 54. Stop screws can be so arranged as to lock the guide rods to said frame 49, whereas the drive means 9 is prevented from falling out thanks to its gripping interaction with the adjustment knobs 34, 35 attached to its end.

The sight holder frame 49 is capable of being screwed securely to the arm by means of screws 55 which are accommodated in a slit-shaped opening 56 in the frame 49 so as to permit displacement of the entire frame 49 in the longitudinal sense of the opening prior to locking by means of a washer with threads on the opposite side of the frame.

Briefly, the sight adjuster in accordance with the present invention may be summarized as offering the following:

high precision and accuracy of adjustment of sight pins, rotation of the threaded rod does not cause a change in position of the sight pin holder, driving of the adjustment is provided externally, and not by the threaded rod, the sight pins can be adjusted individually in a lateral sense, and can be moved closer together and made shorter, double guides permit reliable locking, the sight can be installed at two different heights, and the sight is simple and reliable in use.

The invention is not restricted to the embodiment described above and illustrated in the drawings, but its design can be varied within the scope of the Patent Claims without departing from the idea of invention. For example, the adjustment device can be executed as a permanently installed component. According to one embodiment, one or more adjustment devices can be permanently supported in a sprung fashion, for example by means of a leaf spring or a pressure spring, by the respective sighting means in such a way as to be pressed down against the effect of the spring force so as to cause the drive means to function in accordance with the foregoing in order to displace the sighting means in question.

We claim:

1. An adjustable sight arrangement for a bow, comprising: at least two independently adjustable means for sighting supported by respective attachment holders, each of said holders displaceable along an adjustment direction and supported by at least two guide rods, each of said attachment holders provided with at least two guide holes for passing a respective guide rod therethrough and an accommodating hole parallelly arranged to said guide holes for accommodating an adjustment shaft common to all of said attachment holders, at least one of said attachment holders selectively threadingly connected to and movable along said adjustment shaft, which said adjustment shaft extends parallel to said guide rods and is provided with an inclined track having at least one thread, each of the attachment holders provided with a respective opening extending between an outside surface and an inside surface of said holder, wherein said opening provides access to said adjustment shaft for relative movement between said attachment holder and said adjustment shaft through manipulation of a manually-operated adjustment device acting through said opening, which said adjustment device includes a connection complementary to the size of said opening and retained therein, thereby enabling said adjustment device to become threadedly connected to said adjustment shaft, said connection integrally including an activation part on a one side thereof and an upright projecting therefrom at another side thereof, which said upright terminates in an engagement means, said engagement means removably enmeshed with the inclined track of the adjustment shaft, wherein rotation of said activating part causes said engagement means to rotationally interact with said adjustment shaft, thereby causing said attachment holder to be displaced along said guide rods.

2. The arrangement as claimed in claim 1, wherein the guide rods are arranged to extend parallel with the adjustment shaft, one said guide rod on each side of said shaft.

3. The arrangement as claimed in claim 2, wherein said attachment holder includes a threaded stop screw hole for accommodating a stop screw therein, said stop screw for locking the sight pin in place.

4. The arrangement as claimed in claim 1, wherein said attachment holder includes a threaded sight pin hole for accommodating a respective threaded sight pin therein, said threaded sight pin hole extending through an outer end of said attachment holder such that said threaded sight pin extends parallel to said accommodating hole when inserted in said sight pin hole.

5. The arrangement as claimed in claim 4, wherein said threaded sight pin hole is disposed laterally from said accommodating hole and along an intended direction of adjustment for the sight pin.

6. The arrangement as claimed in claim 5, wherein said attachment holder includes a threaded stop screw hole for accommodating a stop screw therein, said stop screw for locking the sight pin in place.

7. The arrangement as claimed in claim 4, wherein said attachment holder includes a threaded stop screw hole for accommodating a stop screw therein, said stop screw for locking the sight pin in place.

8. The arrangement as claimed in claim 1, wherein said attachment holder includes a threaded stop screw hole for accomodating a stop screw therein, said stop screw for locking the sight pin in place.

* * * * *